340-566

12/21/82 XR 4,365,239 SR

United States Patent [19]

Mongeon

[11] 4,365,239

[45] Dec. 21, 1982

[54] INTRUSION WARNING SYSTEM

[75] Inventor: Ronald W. Mongeon, San Jose, Calif.

[73] Assignee: Stellar Systems, Inc., San Jose, Calif.

[21] Appl. No.: 208,779

[22] Filed: Nov. 20, 1980

[51] Int. Cl.[3] ..... G08B 13/12

[52] U.S. Cl. ..... 340/564; 73/658; 340/526; 340/566

[58] Field of Search ..... 340/526, 529, 564, 566, 340/550; 73/594, 658, 786; 367/136

[56] References Cited

U.S. PATENT DOCUMENTS

| | | | |
|---|---|---|---|
| 3,763,482 | 10/1973 | Burney et al. | 340/564 |
| 3,803,548 | 4/1974 | Skujins, Jr. | 340/566 X |
| 3,836,899 | 9/1974 | Duvall et al. | 340/566 |
| 3,922,663 | 11/1975 | Lubke et al. | 340/261 |
| 3,947,835 | 3/1976 | Laymon | 340/566 |
| 4,047,166 | 9/1977 | Miller et al. | 340/566 X |

*Primary Examiner*—John W. Caldwell, Sr.
*Assistant Examiner*—Joseph E. Nowicki
*Attorney, Agent, or Firm*—Spencer & Kaye

[57] ABSTRACT

An intrusion warning system for protecting a wall or fence, in particular a chain-link fence, against intrusion by cutting through and/or climbing over same. A small-diameter shielded electrical cable, e.g. a coaxial cable or a shielded twisted pair is mounted on the fence and the vibrations of the fence detected by sensing the small electrical field generated when the dielectric material between the conductors of the cable is stressed by the minute flexing of the cable caused by such vibrations. The sensed electric field signal is AM detected, shaped and then processed as to duration and persistence. An alarm indicating an attempted cut-through type of intrusion is activated if a preselected number of signals of very short duration, indicating abrupt disturbances of the fence, are detected. A separate alarm indicating an attempted climb-over intrusion is activated only if the detected signal persists for a period of time longer than that of the signals used for the cut-through indication and is present for a predetermined portion of a preset time period.

14 Claims, 2 Drawing Figures

CUT-THROUGH ALARM CIRCUIT
34
COUNTER
32
33
COUNT SELECTOR TIMER
30
CLIMB OVER ALARM CIRCUIT
60
1 SHOT PULSE GEN.
58
2 SEC
1.6 SEC
21
1 SHOT PULSE GEN.
20
GATE OR CLAMP
24
GATE OR CLAMP
40
INVERTING COMPARATOR
56
62
64
54
25
27
26
52
19
REF
43
10 SEC
50
46
SCHMITT TRIGGER
18
10 SEC
45
44
48
CLIMB OVER TIME ADJ.
BUFFER AMP.
16
1 SHOT PULSE GEN.
42
15
14
13
ACTIVE BAND PASS FILTER
12
PREAMP
10
11
2
SENSOR CABLE
TO PREAMP 10 OF FIG. 2
2
1

INTRUSION WARNING SYSTEM

BACKGROUND OF THE INVENTION

The present invention relates to a warning or alarm system for protecting a perimeter fence or structure against cutting through or climbing over same by an intruder. More particularly, the present invention relates to such a system for a fence or structure wherein a shielded electrical cable is attached to the structure and the minute flexing of the cable when an attempted intrusion occurs is detected to provide an alarm to indicate whether a cut-through type or a climb over type of intrusion is being attempted.

When an insulated electrical cable is flexed, or when pressure is applied thereto, the resulting stress produced in the previously uncharged dielectric material of the cable by the movement results, due to the triboelectric effect, in the generation of a very small electric field signal which may be sensed with appropriate sensing circuitry. When such a cable is attached to a flexible wall structure or fence, for example a chain-link fence, minute flexing of the cable due to vibration of the fence results in the generation of an electric field signal corresponding to these vibrations. However, electric field signals will be produced both by fence vibrations, and hence electrical cable vibrations, which are desired to be detected, i.e. vibrations caused by attempted intrusions, as well as by fence vibrations which are not desired to be detected, i.e. vibrations from extraneous sources, such as wind, nearby freight trains and trucks, etc. Since the detection of these extraneous source caused signals could lead to false alarms, special signal processing is required in order to distinguish signals originating from intruder related vibrations from those originating from extraneous source related vibrations.

In order to provide adequate protection for a wall or fence, it is desired to know whether an intruder is attempting to cut through the fence or is attempting to climb over same. In general, the signals resulting from attempts to cut through a fence are of short duration, are abrupt, and are generally repeated a number of times within a predetermined short period of time. On the other hand, signals corresponding to attempts to climb over a flexible fence generally have longer duration in that they have a lower base frequency than cut-through types vibration signals and persist for a longer period of time.

SUMMARY OF THE INVENTION

It is a primary object of the present invention to provide a system for protecting a fence against intrusion utilizing the electric field signal produced by the flexure of a shielded electrical cable attached to the fence, wherein the susceptibility of false alarms due to extraneous non-intrusion related signals is reduced, and wherein an alarm is produced indicating an attempt to cut through and/or climb over the fence.

The above object is achieved according to the present invention in that an apparatus is provided which includes a length of shielded electrical cable, including at least one center conductor surrounded by a dielectric material, mounted on a fence to be protected, a first circuit means connected to one end of the electrical cable for sensing the change in the electric field signal generated by the stressing of the cable dielectric due to flexing of same by the movement of the fence and for producing an electrical signal corresponding to the sensed electrical field signal, an AM detector connected to the output of the first circuit means for detecting the peaks of the produced electrical signal, a second circuit means for producing an output signal whenever the detected signal has a duration less than a first predetermined short value, a count selector circuit means for counting the output signals from the second circuit means and for producing an output signal whenever the counting selector circuit means reaches a predetermined count, and an alarm circuit, responsive to the output signal from the count selector circuit means, for producing an alarm, whereby protection against intrusion by cutting through the fence is provided.

In order to provide protection of the fence against intrusion by climbing over same, the system or apparatus additionally includes a further circuit means for providing an output signal whenever the detected signal has a duration greater than the first predetermined value, and an additional circuit which is responsive to the output signal from the further circuit means for producing an alarm if the further circuit means produces an output signal for a predetermined portion of a preset time period whose duration is greater than said first predetermined value.

In general, the first predetermined value or duration is approximately 1.6 seconds whereas the time period for determining the persistance of the signals used to detect a climb-over intrusion is approximately ten seconds. It should further be noted that according to a further feature of the invention, the count selector circuit used to count the short duration pulses indicative of a cut-through intrusion only counts same if succeeding pulses are received within a preset time duration which again is approximately in the order to ten seconds.

DETAILED DESCRIPTION OF THE PREFERRED EMBODIMENTS

Figures 1, 2:
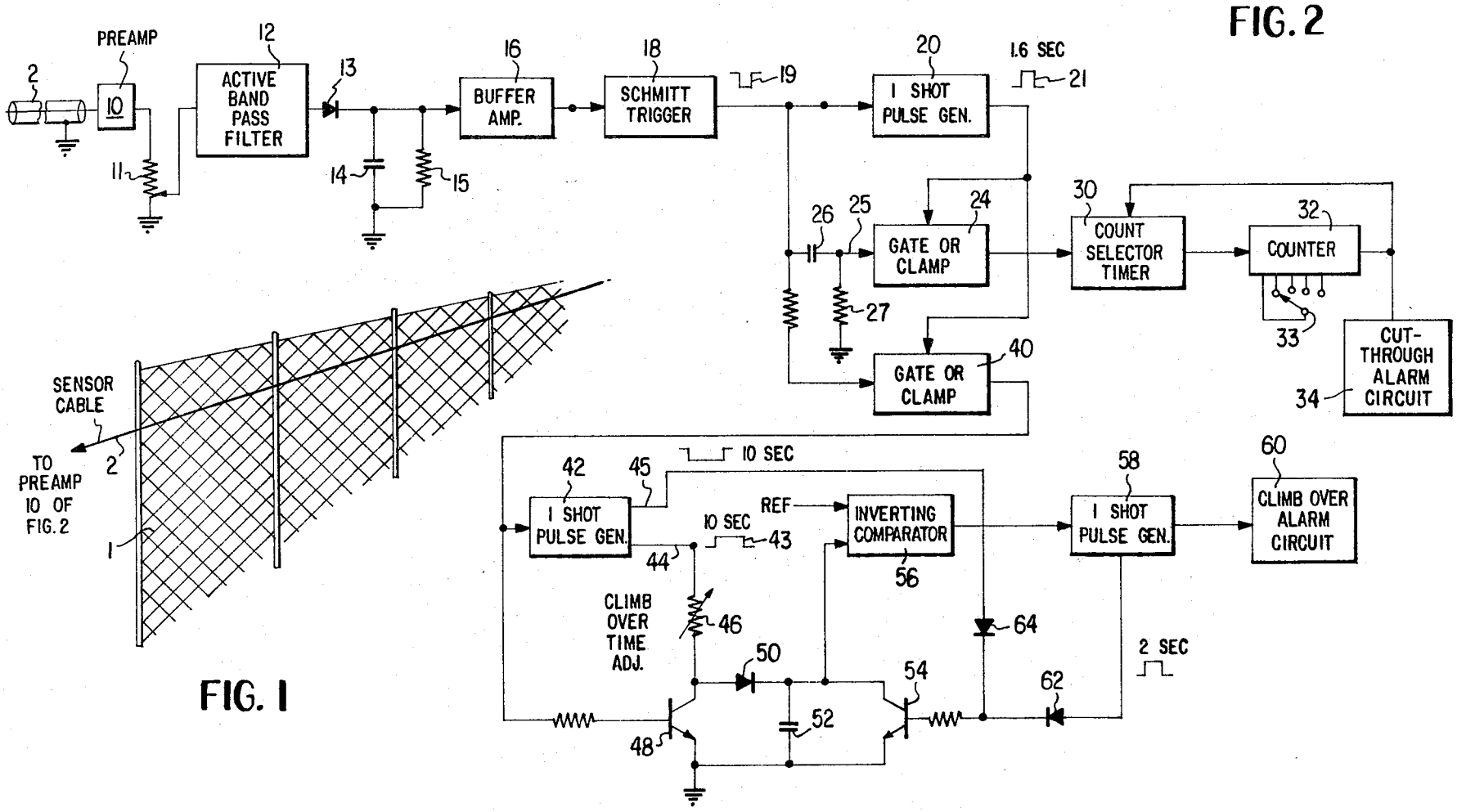
FIG. 1 is a schematic illustration showing a chain-link fence having a shielded electrical cable mounted thereon for sensing vibrations of the fence.
FIG. 2 is a block circuit diagram of an intrusion warning system for protecting a fence according to the invention.

Referring now to FIG. 1 of the application, there is shown a chain-link fence 1 having a length of shielded cable 2 attached thereto and in a suitable manner. It is to be understood that, although not shown, the chain-link fence or another type of fence, can extend completely around the perimeter of an area to be protected, and the length of the shielded electrical cable utilized may be in the order of, or be as long as 1,000 feet. It is further to be noted that although the invention is primarily intended for the protection of chain-link type fences, it can likewise be used for a wall, in which case the shielded electrical cable would be attached to the wall in a zig-zag manner.

The shielded electrical cable may be a conventional electrical coaxial cable including an inner conductor surrounded by an outer or shield conductor and having a layer of an insulating dielectric material therebetween. Usually the outer surface of the shielded conductor is covered with insulating material as a protective outer coating. Alternatively, the shielded electrical cable may be a shielded twisted pair. That is, the cable 2 may include an inner conductor formed of a twisted pair of insulated conductors and an outer conductor or shield. In fact such a shield twisted pair cable is preferably used for fence applications whereas the coaxial cable or coax is used for solid wall installations. Typically, the shielded electrical cable has a diameter of from 0.145 to 0.20 inches.

Referring now to FIG. 2, the inner conductor of the sensor cable 2 attached to the fence is fed to a circuit arrangement for sensing the electrical field generated due to flexing of the cable 2 and for producing an electrical signal corresponding to same. The circuit for sensing the electric field generally includes a pre-amplifier 10 which in view of the very small signal produced by the cable 2 should be a high gain amplifier. Preferably, the pre-amplifier stage additionally has a high input impedence-low leakage current input stage and is of the type disclosed in U.S. Pat. No. 3,956,743 issued May 11, 1976 to T. D. Geiszler et al. The output signal from the pre-amplifier 10 is fed through a potentiometer R1, which serves as a sensitivity control to permit control over the amount of flexing or signal required to subsequently produce an alarm, to an active bandpass filter 12. The active bandpass filter 12 is in effect a further high-gain operational amplifier which is provided with bandpass filtering arrangement which is preferably designed so that it is centered at 300 hz and has a −3 db band width of approximately 60 hz. The centering of the passband of the filter 12 at approximately 300 hz, and not at a lower value, is an attempt to filter out undesired signals originating from the vibrations of the fence due to wind movements, nearby freight trains, trucks, etc. Centering of the passband of the filter 12 at a higher frequency could result in undesirable signals from extraneous electrical sources being detected.

The amplified and filtered AC electrical signal provided at the output of the filter 12 is then passed through an AM detector including a diode 13, a capacitor 14 and a resistor 15. The detector circuit is dimensioned so that it is essentially a fast-rise, slow-decay detector and essentially rises the peaks of the signal corresponding to the fence vibration activity. For example, the resistor 15 may be 10 megaohms and the capacitor 14 may be 0.1 microfarads.

The output signal from the detector is then passed through a unity gain buffer amplifier 16 to a Schmitt trigger 18, which is of the inverting type, in order to produce a definitive high-low signal from the signal produced by the AM detector. The output signal produced by the Schmitt trigger 18 is in the form of a negative pulse 19 as shown adjacent the output of the Schmitt trigger 18. This negative output pulse 19 from the Schmitt trigger 18 is fed to a one-shot multivibrator 20 which responds to the leading edge of the negative pulse 19 to produce a single output pulse of a fixed, short duration which is indicated by the reference numeral 21 adjacent the output of the one-shot pulse generator 20. This output pulse 21, which, as illustrated, is positive and has a time duration of 1.6 seconds, is used in a manner to be described below to provide an initial criteria with regard to pulse length as to whether the detected signal originated from an attempted cut-through of the fence or a climb-over of the fence.

According to the present invention, an attempted cut-through intrusion of the fence, and consequent activation of the cut-through alarm, is detected by determining whether the detected signal indicates that the fence has been abruptly disturbed a predetermined number of times, preferably within a preset maximum time period. In order to provide such detection, the output pulse 21 of the one-shot pulse generator 20 is fed to a first gate or clamp circuit 24 to release or open same and enable it to pass signals applied to its input 25 during the duration of the applied pulse 21, i.e. approximately 1.6 seconds in the preferred illustrated embodiment. The gate or clamp circuit 24 may be of any known design and in its simplest case may be comprised of a diode network which is released by the applied positive pulse.

Connected to the input 25 of the gate or clamp circuit 24 via a differentiating circuit including series capacitor 26 and shunt resistor 27 is the output of the Schmitt trigger 18. Consequently, with this arrangement, if the detected fence disturbance signal appearing as a shaped negative pulse at the output of the Schmitt trigger 18 has a duration greater than the period of time for which the gate or clamp circuit 24 is released, i.e. 1.6 seconds in the preferred illustrated embodiment, then the differentiating circuit 26–27 will not provide any input signal at the input 25 during the time that the gate or clamp circuit 24 is released. However, if the negative pulse 19 at the output of the Schmitt trigger 18 should end within the 1.6 second period that the gate or clamp 24 is released, then the differentiating network 26–27 will differentiate the trailing edge of the pulse 19 to provide a positive pulse which will pass through the gate or clamp 24 to a count selector circuit including a count selector timer 30 and a presettable counter 32.

Each pulse passing through the gate or clamp circuit 24 is fed to the timer 30 which triggers same for a preset period of time, for example, ten seconds, during which period of time the counter 32 is likewise activated. Each pulse passing through the circuit 24 is likewise fed to the counter 32 which will produce an output signal whenever a preselected count is reached. As illustrated, the counter 32 is provided with a selector switch 33 so that it can be preset to produce an output signal after reaching a selected count of from one to four.

In operation of the count selector circuit 30–33, if the count selector switch 33 is set to the first position, the first output signal from the circuit 24 will trigger the timer 30, thus activating the counter 32 which will immediately reach its preselected count and produce an output signal. This output signal is then fed to and activates an alarm circuit 34, which may include the conventional driver relays and audible alarms contained in such circuits, to indicate an attempted cut-through of the fence. If, the count selector 33, rather than being set at the first position, is set at the fourth position, then the first output signal from a circuit 24 will, as in the previous case, trigger the timer 30 to activate the counter 32 for a ten second period and cause the counter 32 to store the count of one. However, in this case no output signal is produced by the counter 32. If a second output signal is received from the circuit 24 during the time that the counter 32 is still activated by the timer 30, then the counter 32 will be advanced to a count of two and the activation of the timer 30 will be extended for an additional period of time, i.e. an additional ten seconds. A similar sequence of operations occurs if a third output signal is provided by the circuit 24 during the time that the counter 32 remains activated by the timer 30. Finally, if a fourth signal passes through the circuit 24 within the time that the counter 32 remains activated by the timer 30, then the counter will be advanced to its preset count of four and produce an output signal to activate the alarm circuit 34. The presence of an output signal from the counter 32 simultaneously resets the timer to zero, which in turns deactivates the counter 32 and likewise causes same to be reset to zero. Of course, the counter 32 is reset to zero at any time that it is deactivated or returned to an inactive condition by the timer 30.

In summary then, the cut-through alarm 34 is activated whenever the fence is abruptly disturbed a number of times corresponding to the setting of the counter 32. Disturbances of the fence which are not abrupt, i.e. produce signals which persist longer than approximately 1.6 seconds, are blocked by the circuit 24, and thus are not considered in any determination or detection of a cut-through type of intrusion, thus eliminating a possible source of false alarms. Signals which do persist for longer than the 1.6 seconds, however, are treated as possible climb-over activity and are processed to determine whether such climb-over activity exists.

In order to detect the presence of climb-over activity on the fence, the output pulse 19 from the Schmitt trigger 18 is fed to the input of a further gate or clamping circuit 40 which is also controlled by the short duration, i.e. 1.6 second, positive output pulse 21 of the one-shot pulse generator 20. However, contrary to the mode of operation of the gate or clamping circuit 24, the gate or clamping circuit 40 is blocked during the period of time that the pulse 21 is applied and is released only at the end of the pulse 21. Consequently, the circuit 40 blocks all signals having a duration less than 1.6 seconds, and provides an output signal only when the input signal to same persists for longer than 1.6 seconds. In its simplest case, and with the indicated polarity for the pulses 19 and 21, the circuit 40 may comprise only a single rectifier connected in the forward direction relative to the pulse 21 and having one terminal connected to the output of the generator 20 and its other terminal connected to the input and to the output of the circuit 40.

The signal appearing at the output of the circuit 40 is fed to a further one-shot pulse generator 42 to trigger same to produce a positive output pulse of a predetermined length, e.g. ten seconds in the illustrated preferred embodiment, at its normal output 44. The output 44 of the pulse generator 42 is connected in series with a variable resistance 46 and the emitter-collector path of a transistor 48, whose base is likewise connected to the output of the circuit 40 and which is normally held cut-off as long as an output signal is being provided by the circuit 40. Connected in parallel with the emitter-collector path of the transistor 48 via a rectifier or charging diode 50 is a storage capacitor 52. As long as the transistor 48 is biased to cut-off via the output signal from the circuit 40, the positive output pulse 43 from the pulse generator 42 is applied to the capacitor 52 via the resistor 46 and the diode 50, causing the capacitor 52 to be charged. If the signal at the output of circuit 40 should cease, transistor 48 will begin to conduct, and remove the charging current from capacitor 52. However, capacitor 52 will hold its charge until actively discharged by the rendering of the transistor 54, whose emitter-collector path is connected in parallel with the capacitor 52, conductive in a manner to be described below. If during the ten second duration of the charging pulse 43 the fence activity begins again and the circuit 40 produces a further output signal, the transistor 48 will again be blocked, resulting in renewed charging of the storage capacitor 52.

The charge across the storage capacitor 52 is continuously monitored by an inverting comparator 56 by comparing same with a reference voltage. The inverting comparator 56, for example, may be simply an operational amplifier. If during the ten second duration of the pulse 43, the transistor 48 has been cut-off for a period sufficient to allow the storage capacitor 52 to be charged so that it reaches the reference value, the output of the comparator 56 will drop in a negative direction and trigger the one-shot pulse generator 58 which produces an output pulse of approximately two seconds in duration on each of its two outputs. One of these outputs is connected to the climb-over alarm circuit 60 and serves, for example, to energize a holding relay conventionally utilized for such alarms. The two second positive pulse appearing on the second output of the one-shot pulse generator 58 is fed via a rectifier 62 to the base of the transistor 54 to render same conductive and discharge the storage capacitor 52 so as to reset the circuit. The transistor 54 is also rendered conductive so as to discharge the capacitor 52 when the one-shot pulse generator 42 resets itself after production of the ten second output pulse on its output 44. That is, at the end of the ten second duration of the output pulse 43, the negated output 45 of the one-shot pulse generator 42 becomes positive and this positive voltage is applied to the base of the transistor 54 via the rectifier 64 so as to render the transistor 54 conductive.

In summary, the climb-over alarm 60 will be activated whenever the detected signal persists for greater than a predetermined minimum period of time and exists for a certain portion of time within a predetermined maximum period of time, i.e. the ten second duration of the pulse 43. The portion of the ten second period of time for which the signal must exist in order to activate the alarm 60, can be adjusted within certain limits by varying the resistor 46 which will change the time required for the capacitor to reach the charge necessary for the comparator 56 to produce an output signal.

It will be understood that the above description of the present invention is susceptible to various modifications, changes and adaptations, and the same are intended to be comprehended within the meaning and range of equivalents of the appended claims.

What is claimed is:

1. Apparatus for detecting the intrusion of a fence comprising: a length of shielded electrical cable mounted on a fence to be protected, said electrical cable including at least one center conductor surrounded by a dielectric material; first circuit means, connected to said cable for sensing the change in the electric field signal generated by stressing of the cable dielectric by the flexing of same due to movement of the fence and for producing an electrical signal corresponding to same; an AM detector connected to the output of said first circuit means for detecting the peaks of the produced electrical signal; second circuit means for producing an output signal whenever the detected signal has a duration less than a predetermined value; count selector circuit means for counting the output signals from said second circuit means and for producing an output signal whenever said count selector circuit means reaches a predetermined count; and an alarm circuit responsive to an output signal from said count selector circuit means for providing an alarm, whereby protection against intrusion by cutting through the fence is provided.

2. The apparatus of claim 1 further comprising a Schmitt trigger for shaping the detected signal, and a timing circuit responsive to the output signal from said Schmitt trigger for providing an output pulse having a duration of said predetermined value, said timing circuit having its output connected to said second circuit means for controlling same.

3. The apparatus of claim 2 wherein said second circuit means includes a gating circuit responsive to said output pulse from said timing circuit for passing signals during the time such pulse is present, and a differentiator circuit, having an input connected to the output of said Schmitt trigger and an output connected to the input of said gating circuit, for differentiating the output signal from said Schmitt trigger.

4. The apparatus of claim 3 wherein said timing circuit is a one shot multivibrator which is responsive to the leading edge of said output signal of said Schmitt trigger, and said differentiator circuit differentiates the trailing edge of said output signal of said Schmitt trigger.

5. The apparatus of claim 3 wherein said count selector circuit means includes a counter which counts the output signals from said second circuit means and which is preset to produce an output when a desired count is reached, and a timer which is responsive to each output signal from said second circuit means to activate said counter for a predetermined period of time whereby said counter only produces an output signal when said preset count is reached within a predetermined maximum time period.

6. The apparatus of claim 5 wherein said predetermined value is approximately 1.6 seconds and said predetermined period of time is approximately 10 seconds.

7. The apparatus of claim 2 further comprising third circuit means, controlled by the output pulse from said timing circuit, for providing an output signal whenever the detected signal has a duration greater than said predetermined value; and fourth circuit means responsive to the output signal from said third circuit means for producing an alarm if said third circuit means produces an output signal for a predetermined portion of a preset time period whose duration is greater than said predetermined value, whereby protection against intrusion by climbing over the fence is provided.

8. The apparatus of claim 7 wherein said predetermined value is in the order of approximately 1.6 seconds said said preset time period is in the order of 10 seconds.

9. The apparatus of claim 7 wherein said third circuit means comprises a further gating circuit for passing an output signal from said Schmitt trigger after termination of the output pulse from said timing circuit; and wherein said fourth circuit means includes: a further timing circuit responsive to an output signal from said further gating circuit for producing an output pulse of a predetermined duration; a storage capacitor; a capacitor charging circuit means for causing said storage capacitor to be charged by the said output pulse of said further timing circuit whenever said further gating circuit produces an output signal; a comparator for producing an output signal whenever the charge on the capacitor reaches a desired value; and a further alarm circuit means responsive to an output signal from said comparator for producing an alarm.

10. The apparatus of claim 9 further including circuit means for discharging said storage capacitor at the end of said output pulse from said further timing circuit or whenever said comparator produces an output signal.

11. The apparatus of claim 9 wherein: said further timing circuit is a one shot pulse generator; said capacitor charging circuit means includes a transistor having a base connected to the output of said further gating circuit means and an emitter-collector path connected between the output of said further timing circuit and a point of reference potential, said charging capacitor being connected across the emitter and collector of said transistor via a charging diode.

12. The apparatus of claim 11 wherein said further timing circuit has a normal and a negated output and said emitter-collector path of said transistor is connected to said normal output of said further timing circuit.

13. Apparatus as defined in claim 12 further comprising a further transistor having an emitter-collector path connected in parallel with said storage capacitor for discharging same when conductive, said further transistor having a base connected to said negated output of said further timing circuit for rendering said further transistor conductive at the end of said output pulse from said further timing circuit; and circuit means connected to the base of said further transistor and responsive to an output pulse from said comparator for rendering said further transistor conductive for a period of time sufficient to discharge said capacitor.

14. Apparatus for detecting the intrusion of a fence comprising: a length of shielded electrical cable, including at least one center conductor surrounded by a dielectric material, mounted on a fence to be protected; first circuit means, connected to said cable, for sensing the change in the electric field signal generated by stressing of the cable dielectric by the flexing of same due to movement of the fence and for producing an electrical signal corresponding to same; an AM detector connected to the output of said first circuit means for detecting the peaks of the produced electrical signal; second circuit means for producing an output signal whenever the detected signal has a duration greater than a predetermined value; third circuit means responsive to output signals from said second circuit means for producing an alarm when said second circuit means produces output signals for a predetermined portion of a preset time period whose duration is greater than said predetermined value, whereby protection against intrusion by climbing over the fence is provided; forth circuit means for producing an output signal whenever the detected signal has a duration less than said predetermined value; count selector circuit means for counting the output signals from said forth circuit means and for producing an output signal whenever said count selection circuit means reaches a predetermined count; and an alarm circuit, responsive to an output signal from said count selector circuit means, for providing an alarm, whereby protection against intrusion by cutting through the fence is provided.

* * * * *